United States Patent [19]

Cole

[11] 4,122,903

[45] Oct. 31, 1978

[54] MOTOR GRADER CIRCLE DRIVE

[75] Inventor: Carroll R. Cole, Decatur, Ill.

[73] Assignee: Caterpillar Tractor Co., Peoria, Ill.

[21] Appl. No.: 696,020

[22] Filed: Jun. 14, 1976

[51] Int. Cl.[2] ..... E02F 3/76

[52] U.S. Cl. ..... 172/781; 74/413; 74/425; 172/747

[58] Field of Search ..... 172/719, 747, 781, 789, 172/791, 792, 793, 795, 796, 797; 74/413, 425, DIG. 10, 424.5; 91/186; 212/66, 67, 68, 69; 214/132, 151

[56] References Cited

U.S. PATENT DOCUMENTS

| | | | |
|---|---|---|---|
| 1,594,987 | 8/1926 | Adams | 74/425 |
| 2,195,306 | 3/1940 | Henry et al. | 172/796 |
| 2,329,733 | 9/1943 | Watson | 74/688 |
| 2,349,642 | 5/1944 | Watson | 74/688 |
| 2,928,381 | 3/1960 | Macdonald | 91/186 |
| 2,973,660 | 3/1961 | Popper | 74/424.5 |
| 3,048,051 | 8/1962 | Pickles | 74/425 |
| 3,067,627 | 12/1962 | Pickles | 74/425 |
| 3,079,808 | 3/1963 | Wildhaber | 74/425 X |
| 3,386,305 | 6/1968 | Wildhaber | 74/425 |
| 3,710,640 | 1/1973 | Stanger et al. | 74/425 |
| 3,851,538 | 12/1974 | Denkowski et al. | 74/425 |
| 3,911,758 | 10/1975 | Hanser et al. | 74/462 |
| 4,004,641 | 1/1977 | Hendrickson | 172/781 |

FOREIGN PATENT DOCUMENTS

| | | | |
|---|---|---|---|
| 1,364,301 | 5/1964 | France | 74/425 |

*Primary Examiner*—Richard T. Stouffer

*Attorney, Agent, or Firm*—Wegner, Stellman, McCord, Wiles & Wood

[57] ABSTRACT

A motor grader circle drive has an internal spur gear secured to the circle, and the internal gear is driven by one or two barrel worm gears, each of which in turn is driven from a hydraulic motor by an input worm and an input spiral gear keyed to the barrel worm gear, each barrel worm gear is journalled on a spindle in a support and is free to move endwise between a pair of radial flanges while being centered by a pair of belleville spring washers so as to compensate for backlash in each barrel worm gear and to permit substantially even distribution of driving force between the barrel worm gears when two are used. This structure operates at very low tooth pressures so as to permit the barrel worm gear to be made of a relatively soft material such as heat treated aluminum. The support, worm gear and input gears are made as a prefabricated sub-assembly, which is easily installed or removed; and using a soft material which wears much faster than the internal gear protects the latter from wear.

20 Claims, 6 Drawing Figures

Fig. 1
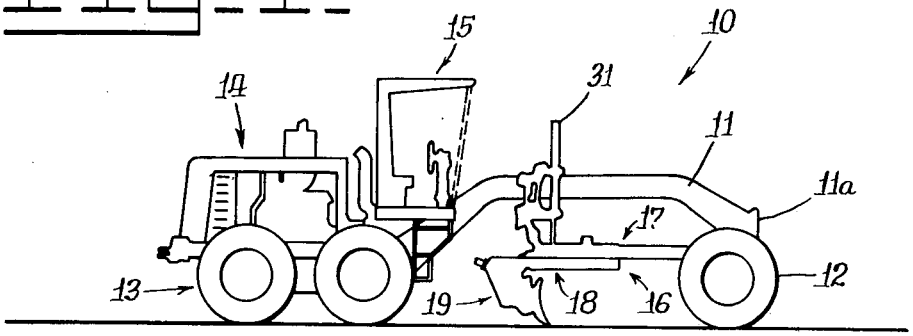
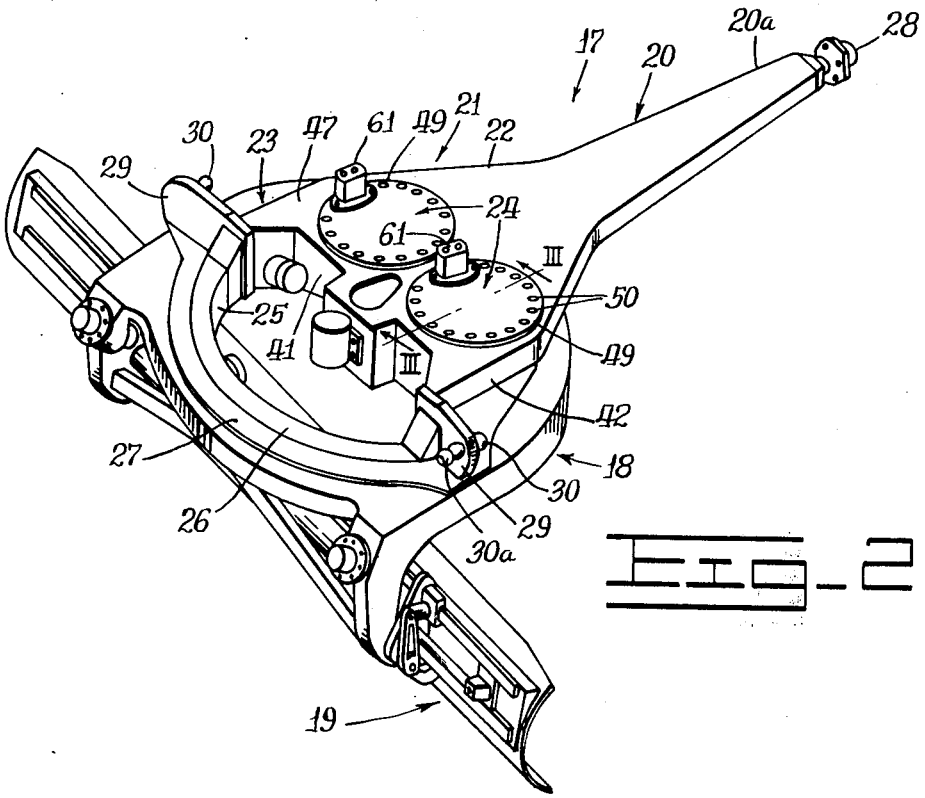
Fig. 2

VI
VI
51
54
80
95
83
52
73
76
72
76
75
90
84
69
71
53
86
74
77
78
82
91
90
89
88
81
82
85
87
79
93
92
93
91
94
95
46
45

24
61
64
70
62
60
49
50
52
57
65
41
56
66
94
58
63
18
45
67
54
79
71
69
46
68
59
55a
55

MOTOR GRADER CIRCLE DRIVE

CROSS REFERENCE TO RELATED APPLICATIONS

Details of the draw bar structure and of the circle mounting bar and circle assembly which are illustrated and described generally in this application are described in detail and claimed in copending U.S. patent applications of Carroll Richard Cole, Ser. No. 661,880, filed Feb. 27, 1976, issued Dec. 27, 1977 as U.S. Pat. No. 4,064,947 and Ser. No. 663,594, filed Mar. 3, 1976 issued Apr. 5, 1977 as U.S. Pat. No. 4,015,669.

BACKGROUND OF THE INVENTION

Motor graders have a longitudinal main frame which has a dirigible wheel assembly at its forward end, an operator's cab at its rearward end portion, and a traction chassis for the motor and power train behind the cab. The motor grader blade is suspended from the main frame by means of a circle draw bar and a circle. The circle draw bar has its front end connected to the front of the main frame by a ball and socket connection, while the rearward portion of the circle draw bar is suspended from the main frame by hydraulic cylinder and piston means which permit the draw bar to swing in a vertical plane about its front end.

The rearward portion of the circle draw bar constitutes a circle carrying structure, and a circle is supported beneath the carrying structure for rotation about a vertical axis. An internal gear, which is preferably a spur gear because of the relative ease of manufacture, is secured to the circle, and the internal gear and circle are driven by a hydraulic motor through a power train which commonly terminates in a pinion of one sort or another engaging the internal gear.

Two types of prior art circle drives which are known to applicant are disclosed in U.S. Pat. Nos. 2,928,381 and 3,911,758.

There are a number of problems with prior art which drives an internal gear of a motor grader circle from a pinion. Perhaps the most serious is that the forces imposed at the tip of an extended motor grader blade are carried back through the internal gear to the pinion and then to the power input for the spur gear. With a typical motor grader having a maximum extended blade reach of 10 ½ feet and a circle of 30 inch radius can produce a contact stress in excess of 700,000 psi on the circle drive pinion. This is sufficient to cause metal to extrude away from the contact area and permanently deform the tooth surfaces. Since the only ultimate braking effort is provided by the input worm drive, substantial damage may be sustained by those components.

Another problem in conventional pinion drives for motor grader circles involves the inherent variations in backlash of the pinion to circle mesh. Where the pinion tooth is nearly at the bottom of the tooth's base, there is almost no backlash, while with the pinion rotated approximately half way from the internal gear tooth dedendum to the internal gear tooth addendum the backlash may be about 0.22 inch even before there has been any tooth wear. This permits the induced blade forces to set up vibrations in the circle and the blade mechanism, as well as in the related structure, which substantially reduces the fatigue life of components. The backlash also causes impact loading on the circle drive mesh which further increases the contact stress and produces further damaging forces in the entire circle drive mechanism. Excessive backlash also causes poor surface finish of the graded surface and inaccuracies in grade and slope. This is because backlash can produce blade tip movement. In a motor grader with the dimensions previously stated, a backlash of 0.22 inch produces 0.92 inch movement at the blade tip.

It appears that the special drive pinion of U.S. Pat. No. 3,911,758 probably reduces the backlash problem.

Another severe problem is that a motor grader blade is normally operated at an angle of approximately 45° from the longitudinal center line of the grader, either to the right or to the left. This causes wear to occur only on a very limited number of circle teeth, and only one tooth of the pinion and the circle mesh carries the entire load. This problem is somewhat obviated in U.S. Pat. No. 2,928,381 where there are two circle pinions engaged with the internal gear, so that wear is spread over more than 90° of the internal gear and two teeth are in engagement at all times. Nevertheless, this only alleviates the problem and may complicate backlash problems because of inherent differences in the backlash between the gear meshing at each of two drive pinions with one of the two meshes carrying the load when the blade force moves the circle to take out the backlash.

Further, the use of a pinion as a circle drive requires very accurate adjustment of the shoes which support the circle in order to maintain proper mesh between the drive pinion and the internal gear. The problem of adjusting the circle supporting shoes is complicated by the fact that the entire motor grader circle, grader blade, blade mounting and circle drive is at least coated with dust and may be caked with mud.

The present invention drives the circle internal gear by means of a barrel worm gear which either eliminates or greatly reduces the problems heretofore referred to.

Barrel worm gears employed with an internal gear are disclosed in U.S. Pat. Nos. 2,329,733 and 2,349,642. Hourglass gears, the reverse of a barrel gear, and used with externally toothed gears, are disclosed in such U.S. Pat. Nos. as 3,048,051, 3,386,305 and 3,710,640.

SUMMARY OF THE INVENTION

The principal object of the present invention is to provide a motor grader circle drive which eliminates or greatly reduces the problems that are inherent in a drive using a pinion as heretofore mentioned. The improved drive is achieved by the following structural features.

1. A barrel worm gear, or preferably two such worm gears set 60° apart, are used to drive the motor grader circle. The barrel worm gear has the same pitch diameter as does the internal gear with which it meshes.

2. The barrel worm gear is on an axis of rotation which is equal to the pitch angle of the helical worm tooth, thus permitting the barrel worm gear or gears to be used with an internal spur gear.

3. The problems and ill effects of backlash are minimized or eliminated by mounting the barrel worm gear for axial movement between a pair of belleville spring washers which center the barrel worm gear between abutments while permitting slight axial movement.

4. The barrel worm gear is made with a lead angle of approximately 5°, which automatically provides substantially complete circle braking action and prevents high forces imposed on the circle drive from entering the input gearing.

The improved structure produces a number of results in addition to eliminating or reducing the problems heretofore discussed. In the first place, tensile stresses are reduced approximately 65% because contact between the helical tooth and the internal gear teeth is always at the pitch line with full tooth contact, instead of there being what is essentially point contact as is true with a pinion drive. In addition, where two barrel worm gear drives are used the contact stresses are no more than about 10% of those experienced at the pinion-internal gear area of mesh.

This permits the barrel worm gear to be made from a much softer material than the steel used for the internal gear- for example, heat treated aluminum may be used; so that tooth wear is limited almost entirely to the relatively inexpensive and easily replaced barrel worm gear, and the life of the internal gear is greatly extended.

The braking force exerted by the barrel worm gear substantially eliminates transmittal of grading forces and impacts to the circle drive input, which permits these components to be of much lighter and less expensive construction than is required with the prior art.

The term "barrel worm gear" is used herein as a convenient, generally descriptive identification of the most significant element of the circle drive of this invention. The barrel worm gear is not a barrel gear in the same sense as that of U.S. Pat. No. 2,329,733, in which the gear surface is generated by rotating a segment of a circle of radius equal to that of the internal gear about an axis which is a chord of the circle defined by the internal gear.

The surface of the barrel worm gear here disclosed is generated by rotating an ellipse about an axis which is parallel to the major axis of the ellipse and in the plane of the ellipse. The result is a surface which gives the general visual impression of being barrel-shaped, but which is not a true barrel shape.

THE DRAWINGS

FIG. 1 is a side elevational view of a motor grader embodying the invention;

FIG. 2 is a perspective view of a sub-assembly consisting of a circle mounting bar, a circle, and a grader blade, in which the circle drive of the present invention is used;

DETAILED DESCRIPTION OF THE INVENTION

Figure 3:
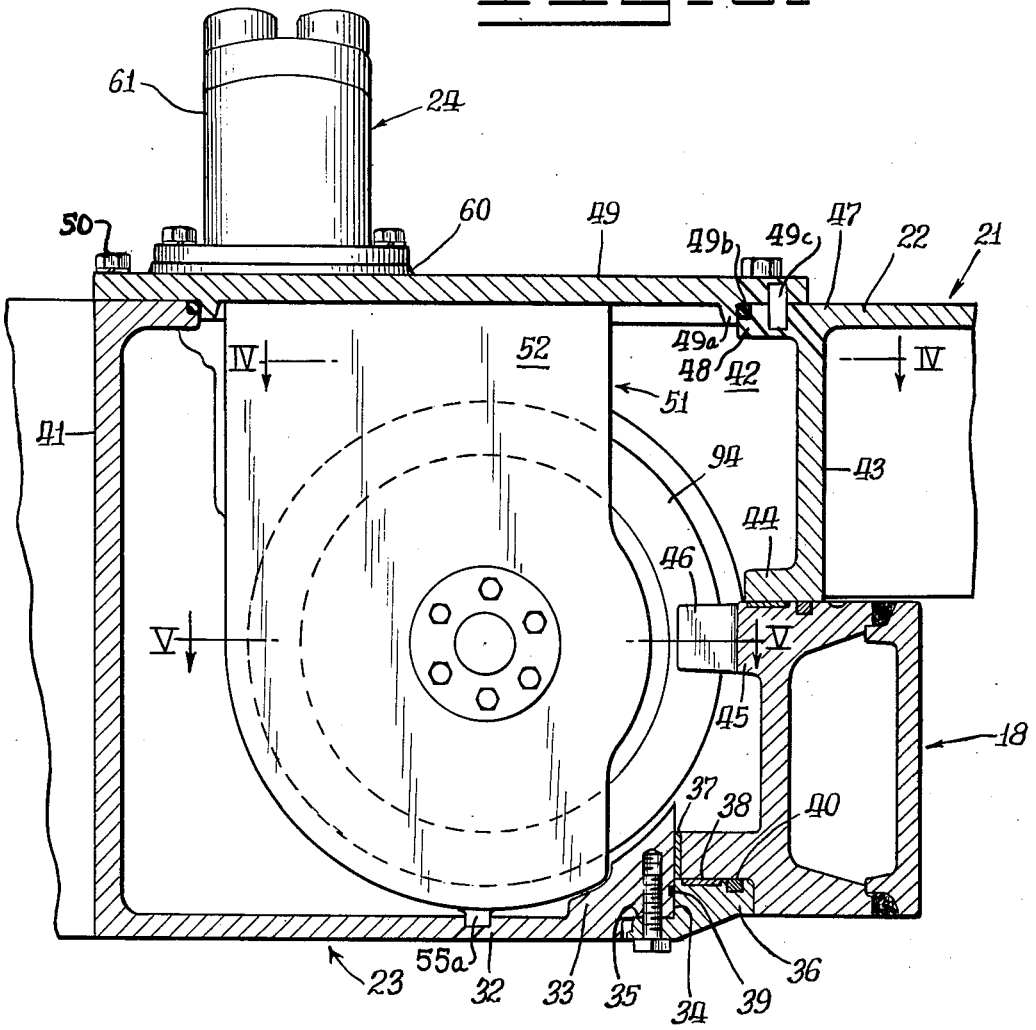
FIG. 3 is a fragmentary, sectional view on an enlarged scale with parts broken away, taken substantially as indicated along the line III—III of FIG. 2.
Figure 4:
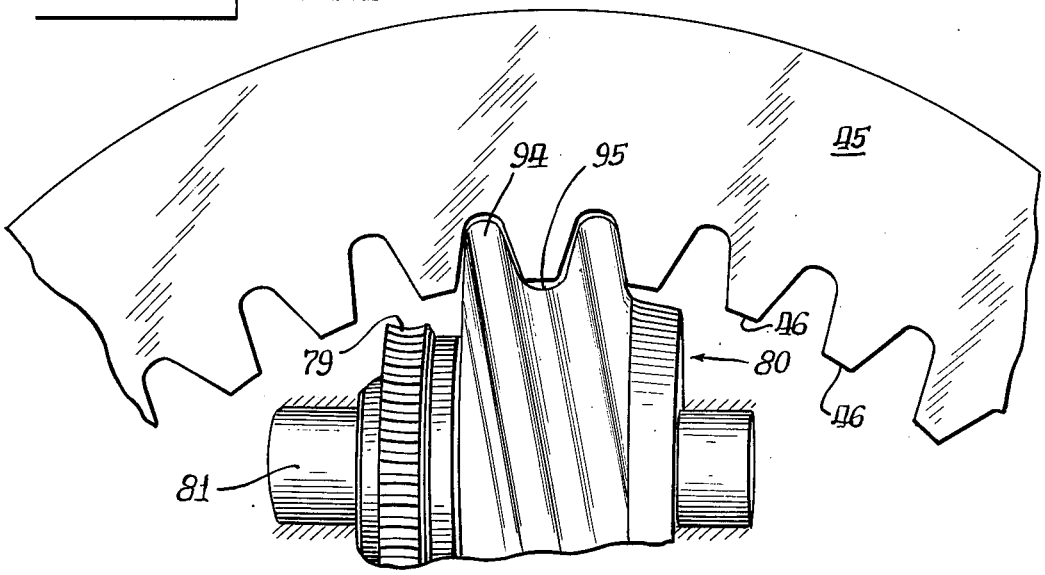
FIG. 4 is a greatly enlarged fragmentary plan view of the barrel worm gear and the internal gear taken substantially as indicated along the line IV—IV of FIG. 3 with numerous parts omitted for clarity.

Referring first to FIG. 1 of the drawings, a motor grader, indicated generally at 10, includes a longitudinal main frame 11 the front end 11*a* of which is supported upon a dirigible front wheel assembly 12, and the rear end of which constitutes part of a traction chassis, indicated generally at 13, on which is mounted a power plant, indicated generally at 14. An operator's cab, indicated generally at 15, is on the rear portion of the main frame, forward of the traction chassis. A grader blade subassembly, indicated generally at 16, consists generally of a circle mounting bar, indicated generally at 17, which in the illustrated apparatus is a draw bar; a circle structure, indicated generally at 18; and a grader blade and blade mounting, indicated generally at 19.

The circle draw bar 17 is best seen in FIG. 2 to include a forward beam, indicated generally at 20, and a rearward circle carrying structure, indicated generally at 21, the forward part 22 of which is integral with the rear end of the beam 20. Behind the part 22 of the carrying structure said carrying portion has a section 23 the depth of which is great enough that it forms a housing extending below the circle 18. The housing section 23 receives a drive means sub-assembly, indicated generally at 24. The housing section 23 of the circle draw bar merges into a nearly semi-annular upright wall 25 which is part of an internal housing for the circle 18, and integral with the wall 25 is a horizontal top wall 26. An integral flange member 27 overlies the more inward portion of the circle.

The subassembly 16 is mounted under the main frame 11 by means of a front mounting element and rear mounting elements which engage with cooperating elements carried upon the main frame. At the front end 20*a* of the circle draw bar is a ball 28 which forms part of a ball and socket connection (not shown) by means of which the front of the circle draw bar is connected for universal movement on the front end 11*a* of the main frame. At the back end of the housing section 23 of the rearward circle draw bar portion 21 is a pair of aligned, laterally extending upright plates 29 which are provided with balls 30 that make ball and socket connections with fittings (not shown) on the lower ends of a pair of hydraulic cylinder and piston units 31 which are carried upon the main frame 11. Thus, operation of the hydraulic cylinder units 31 swings the circle draw bar 17 about the ball and socket connection including the ball 28, which in this respect provides a horizontal pivot axis. A ball 30*a* on one of the webs 29 provides for a ball and socket connection with a side-shift cylinder (not shown) which shifts the draw bar sideways, with the ball 28 providing a vertical pivot axis.

Referring now to FIG. 3, the housing 23 has a bottom plate 32 which is below the plane of the circle 18 and extends continuously around the circle carrying structure 21, the rearward portion of the bottom plate 32 being semi-annular in shape and welded along the lower margin of the semi-annular upright wall 25. The periphery of the bottom plate 32 is circular, and at its forward portion is an upstanding lip 33 which has an upright outer surface 34 and a shoulder 35 which receive a removable ring 36 that supports the circle 18. There is an antifriction wear strip 37 between the face 34 of the lip and the circle 18, and an antifriction wear strip 38 is also positioned between the ring 36 and the circle 18. A seal 39 in the face 34 and a seal 40 in the upper surface of the ring 36 prevent lubricant from leaking out of the chamber 23. Similar antifriction wear strips and seals are associated with the circle 18 and the ring 36 throughout their circumferences.

The laterally extending upright plates 29 close the rear of the housing 23 at its two sides, and a generally transverse, upright wall structure 41 connects the plates 29 to form the rear of the housing 23. An upright enclosing wall 42 connects at its rear end with the plates 29 outwardly of the rear housing wall 41, extending along both sides of the housing and having an arcuate forward portion 43 along the lower margin of which is an inwardly extending flange 44 which cooperates with the upright lip 33 to define a drive opening which is closed by the inward portion of the circle 18 and into which an integral internal spur gear 45 of the circle extends so that its teeth 46 may be engaged by a part of the drive means 24 as will be described.

Surmounting the housing 23 is a top plate 47 which is welded to the peripheral wall 42, the upright back wall 41 of the housing, and the upright transverse plates 29. The top plate 47 has two openings 48, one of which is seen in FIG. 3, and said openings accommodate the two drive means sub-assemblies 24.

Each of the drive means sub-assemblies 24 includes a circular mounting plate 49 which serves as a closure for one of the openings 48. The mounting plate has a pilot flange 49*a* surrounded by a seal 49*b*, and an indexing dowel 49*c* seats in a blind bore in the top plate 47. A circumferential array of machine screws 50 secure the plate 49 to the top plate 47.

Figure 5:
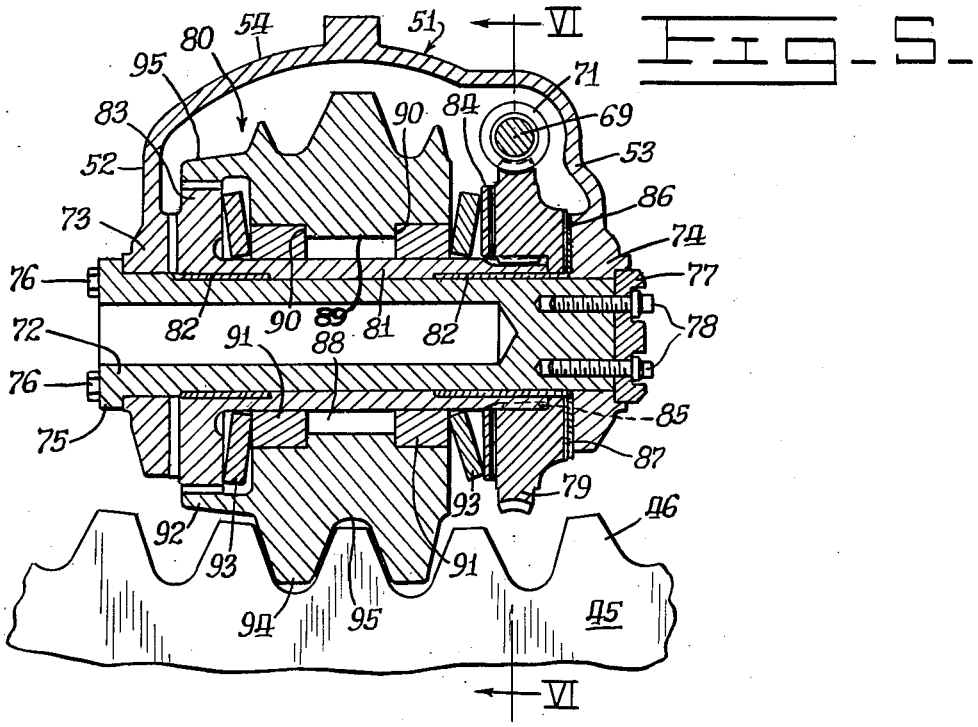
FIG. 5 is a fragmentary sectional view taken substantially as indicated along the line V—V of FIG. 3.
Figure 6:
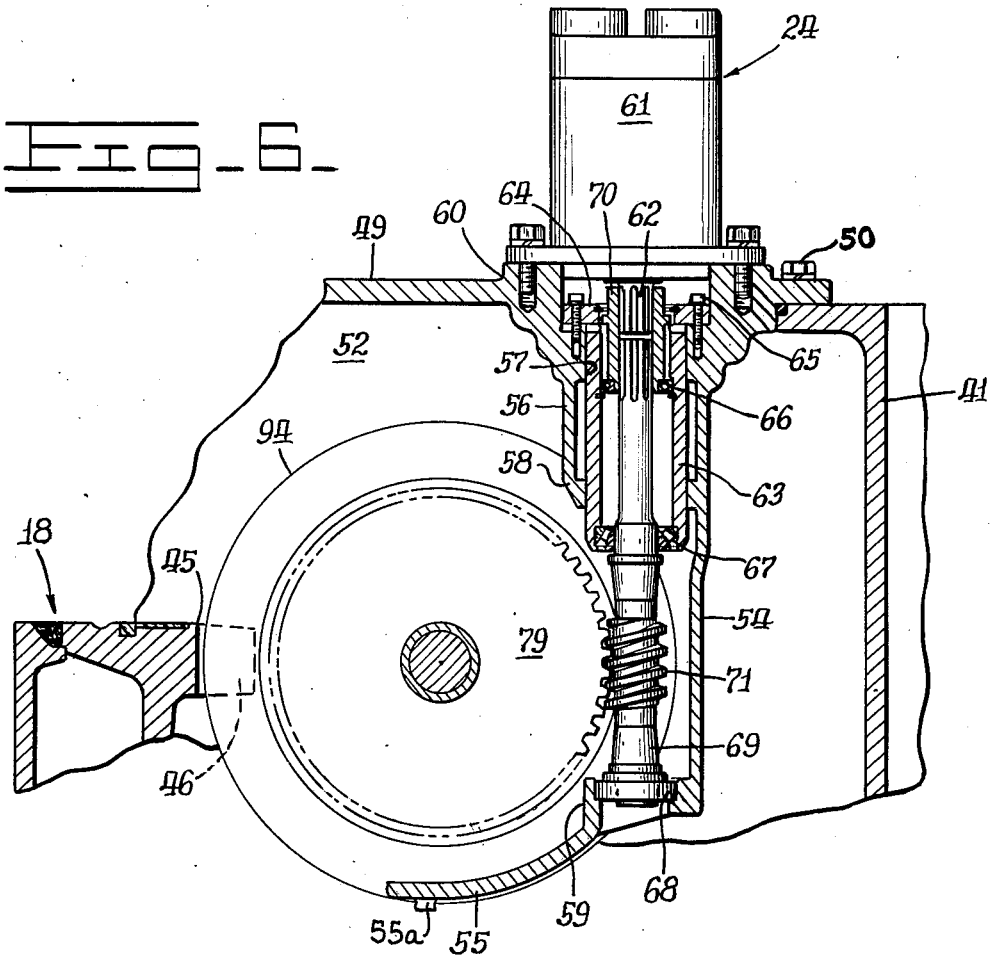
FIG. 6 is a fragmentary sectional view taken substantially as indicated along the line VI—VI of FIG. 5.

Secured beneath the mounting plate 49 is a support, indicated generally at 51, which is seen in FIGS. 3, 5 and 6 to consist of a molded or a die cast frame which has end members 52 and 53 connected by a rear wall 54, and an arcuate bottom wall 55 with a pilot boss 55*a* that seats in a blind bore in the bottom plate 32. Formed integrally with the mounting plate 49 just inside the juncture of the walls 53 and 54 is a sleeve 56 which has upper and lower inturned flanges 57 and 58, respectively. Formed in the bottom 55 of the support in axial alignment with the sleeve 56 is a hollow boss 59. At the upper end of the sleeve 56, on the top surface of the mounting plate 49, is an annular boss 60 which serves as a support for a hydraulic motor 61 which has a splined output shaft 62 extending into the upper portion of the sleeve 56 above the upper flange 57. Removably mounted in the sleeve 56 is a bearing support tube 63 the upper end of which has an external flange 64 that overlies the upper internal flange 57, and small fastening screws 65 secure the tube 63 in the sleeve 56.

An upper antifriction bearing means 66 and a lower antifriction bearing means 67 are fixed in the tube 63, and a bearing ring 68 is seated in the annular boss 59; and a drive shaft 69 which has a splined slip connection 70 at its upper end is journalled in the bearings 66, 67 and 68, with its splined slip connection 70 in driving engagement with the hydraulic motor output shaft 62. On the drive shaft 69 is a drive worm gear 71.

Referring now to FIG. 5, a mounting spindle 72 is carried in hollow bosses 73 and 74 in the respective support side walls 52 and 53. The spindle 72 has a flange 75 which overlies the outer surface of the boss 73 and receives fastening screws 76; while the opposite end of the spindle 72 seats in the boss 74 and receives a removable fastening disc 77 and screws 78 which screw into tapped bores in the end of the spindle 72. Journalled on the spindle 72, by means which will be described, are a spiral input gear 79 which is in driving engagement with the worm drive gear 71, and a barrel worm gear, indicated generally at 80.

The mounting for the input gear 79 and the barrel worm gear 80 comprises a sleeve 81 which is journalled upon the spindle 72 on sleeve bearings 82; and the sleeve 81 has a fixed radial abutment 83 at one of its ends and a removable radial abutment 84 at its other end. Longitudinal keyways 85 in the sleeve 81 receive internal fingers of the abutment 84 and also receive keys on the spiral input gear 79 which has an outer end face 86 that is separated from the boss 74 by thrust bearings 87.

The barrel worm gear 80 has an axial bore 88 with an inset central portion 89 that defines outwardly facing shoulders 90, and in the two ends of the bore 88 abuting the shoulders are annular inserts 91. One end portion 92 of the barrel worm gear 80 surrounds the fixed radial abutment 83, and the opposite end portion of said barrel worm gear is spaced from the removable radial abutment 84. The barrel worm gear 80 with its annular inserts 91 is free to move axially upon the sleeve 81, and is biased to a center position between the abutments 83 and 84 by belleville springs 93 which have their inner margins bearing upon the inserts 91 and their outer margins bearing upon the abutments 83 and 84, respectively.

The barrel worm gear 80 has a helical tooth 94. The barrel worm gear 80 has its longitudinal surface 95 which is the base of the helical tooth 94 convexly curved; and said surface 95 is generated by rotating an ellipse about an axis which is parallel to the major axis of the ellipse and in the plane of the ellipse. The result is a surface which gives the general visual impression of being barrel-shaped, but which is not a true barrel shape. The pitch radius of the helical tooth 94 is the same as the pitch radius of the internal gear 45. Additionally, the barrel worm gear 80 has a lead angle of approximately 5°, and its axis of rotation provided by the axis of the fixed spindle 72 is set at said angle of approximately 5° to the plane of the internal gear 45 which makes it possible for the internal gear to be a simple spur gear. With the pitch radius of the helical tooth 94 the same as that of the internal gear 45, the helical tooth 94 has a wide area of surface engagement with the internal spur gear teeth 46, and during its rotation either one or two turns of the helical tooth 94 are engaged with the spur gear teeth 46. This, combined with the large area of contact between the helical tooth 94 and the teeth 46, affords very low bearing pressures between the helical tooth and the spur gear teeth.

Additionally, as seen in FIG. 2, there are two drive means sub-assemblies 24 each of which has a barrel worm gear 80 engaging internal gear teeth 46, so the driving load is divided between the two; and in addition the areas of engagement of the two barrel worm gears with the internal gear are 60° apart which spreads the wear on the internal gear teeth 46 over a substantially larger arc than is the case where only a single drive gear is used with the internal gear.

The greatly reduced forces at the engaging surfaces of the teeth makes it possible to fabricate the barrel worm gear 80 from a relatively soft material, such as heat treated aluminum, so that gear wear is almost entirely restricted to the relatively inexpensive and easily replaced barrel worm gear, leaving the expensive and hard to replace internal gear with very little tooth wear.

Each of the drive means 24 may be readily removed from the circle carrying structure 21 by removing the fastening screws 50 and lifting it out of the housing 23. There is no tooth interference at any position of the barrel worm gear 80, so each of the drive means 24 may be easily mounted in and removed from the housing 23.

The floating mount of the barrel worm gears 80 between the belleville springs 93 permits them to adjust to backlash, so that differences in backlash on the two barrel worm gears 80 at various times during the operation of the device are automatically compensated and the driving force is quite closely balanced between the two barrel worm gears 80 at all times.

The driving load exerted on the drive means support 51 is carried into the top plate 47 by the mounting plate 49 and the dowel 49*c* and screws 50, and is also carried into the bottom plate 32 by the pilot boss 55*a*, thus distributing the load about the housing 23.

Sealing of the housing 23 by the seals 39, 40 and 49*b* permits the housing to serve as a sealed lubricant chamber, so the drive gear 71, the input gear 79, and the barrel worm gear 80, as well as the internal gear teeth 46 where they engage with the helical tooth 94, are all operating in an oil bath.

The foregoing detailed description is given for clearness of understanding only and no unnecessary limitations should be understood therefrom as modifications will be obvious to those skilled in the art.

What is claimed is:

1. In a motor grader which includes a circle carrying structure, a circle supported beneath said carrying structure for rotation about a vertical axis, and an internal spur gear of predetermined pitch diameter secured to said circle, improved means for driving said internal spur gear comprising, in combination:

a support detachably mounted on the circle carrying structure inside the circle defined by the internal spur gear;

a mounting spindle in the support;

a tube journalled on said spindle;

a barrel worm gear, non-rotatably mounted for axial sliding movement on the tube, said worm gear having a helical tooth which is engaged with the internal spur gear teeth, said helical tooth having a pitch diameter effectively equal to that of the internal spur gear and having a predetermined lead angle, said worm gear having a convex longitudinal surface with a radius of curvature substantially equal to and no greater than that of the internal spur gear, and said worm gear having an axis of rotation which is tilted with reference to the plane of the internal spur gear on an axis which is substantially equal to the lead angle of the helical tooth;

radially extending flanges secured to the tube to restrict said axial sliding movement of the barrel worm gear;

spring means bearing on the ends of the barrel worm gear and said flanges to bias said barrel worm gear to a position centered between the flanges;

and means for driving said barrel worm gear.

2. The combination of claim 1 in which the lead angle of the helical tooth is of the order of 5°.

3. The combination of claim 1 in which the lead angle of the helical tooth varies, and the axis of rotation is tilted at an angle which is substantially equal to the mean lead angle.

4. The combination of claim 3 in which the mean lead angle is of the order of 5°.

5. The combination of claim 1 in which the spring means are belleville washers.

6. The combination of claim 5 in which the tube has a portion which extends longitudinally beyond one of said flanges, and the means for driving the barrel worm gear includes an input gear keyed to said portion of the tube.

7. The combination of claim 1 in which the internal spur gear is of hard metal, the barrel worm gear is of a rigid material substantially softer than said hard metal, and the support and the barrel worm gear are a prefabricated sub-assembly which is readily removable and replaceable without disturbing the internal spur gear.

8. The combination of claim 7 in which the barrel worm gear has a through bore with a pair of spaced annular inserts of hard metal mounted therein and supported on the tube for axial sliding movement, and the spring means are a pair of belleville spring washers mounted on the tube with a washer between and bearing upon each flange and the adjacent hard metal insert.

9. The combination of claim 1 in which the improved driving means includes a second support independent of said first support and detachably mounted on the circle carrying structure inside the circle defined by the internal spur gear, said second support being identical with the first named support and being separated therefrom by about 60°, and a second barrel worm gear journaled in said second support, the structure, mounting, and tooth engagement of said second barrel worm gear being effectively identical with that of said first named barrel worm gear.

10. The combination of claim 9 in which there is a second mounting spindle in the second support, a second tube is journalled on said second mounting spindle, said second barrel worm gear is non-rotatably mounted for axial sliding movement on said second tube, radially extending second flanges are secured to said second tube to restrict said axial sliding movement of said second barrel worm gear, and second spring means bears on said second flanges and second barrel worm gear to bias said second barrel worm gear to a position centered between the second flanges.

11. The combination of claim 1 in which the means for driving the barrel worm gear comprises an input gear keyed to said barrel worm gear and a drive gear engaging said input gear.

12. The combination of claim 11 in which the drive gear is a worm gear and the input gear is a spiral gear.

13. The combination of claim 1 in which the support includes mounting means which connects to an upper part of the circle carrying structure and pilot means which engages a lower part of said carrying structure, whereby driving forces on the support are distributed between said upper and lower parts.

14. The combination of claim 10 in which the spring means and the second spring means are belleville washers.

15. In a motor vehicle which includes a mobile frame, a first member on said mobile frame and a second member on said mobile frame which is rotatable relative to said first member about a vertical axis, improved means for driving said second member comprising, in combination:

an internal spur gear of predetermined pitch diameter of one of said members:

a support detachably mounted on the other of said members inside the circle defined by the internal spur gear;

a barrel worm gear journalled in said support, said worm gear having a surface defined by rotating an ellipse about an axis which is parallel to the major axis of the ellipse and in the plane of the ellipse, and having a helical tooth in said surface which is engaged with the internal gear teeth, said helical tooth having a pitch diameter effectively equal to that of the internal spur gear and having a predetermined lead angle, said worm gear having a convex longitudinal surface with a radius of curvature substantially equal to and no greater than that of the internal spur gear, and said worm gear having an axis of rotation which is tilted with reference to the plane of the internal spur gear on an axis which is substantially equal to the lead angle of the helical tooth, whereby maximum surface contact is constantly maintained between the helical tooth and the internal spur gear teeth at the pitch line so as to minimize tooth contact pressures and stresses at the roots of the internal spur gear teeth and so the support with the barrel worm gear journalled in it may be moved vertically to engage and disengage the helical tooth with the internal spur gear teeth;

and gear means journalled in said support for driving said barrel worm gear.

16. In a motor grader which includes a circle carrying structure, a circle supported beneath said carrying structure for rotation about a vertical axis, and an internal spur gear of predetermined pitch diameter secured to said circle, improved means for driving said internal spur gear comprising, in combination:

a mounting plate detachably mounted on an upper part of the circle carrying structure above the internal spur gear and inside the circle defined by said internal spur gear;

a support fixed to the underside of the mounting plate;

an upright drive shaft journalled in said support;

a barrel worm gear journalled in said support alongside said drive shaft, said worm gear having a helical tooth which is engaged with the internal spur gear teeth, said helical tooth having a pitch diameter effectively equal to that of the internal spur gear and having a predetermined lead angle, said worm gear having a convex longitudinal surface with a radius of curvature substantially equal to and no greater than that of the internal spur gear, and said worm gear having an axis of rotation which is tilted with reference to the plane of the internal spur gear on an axis which is substantially equal to the lead angle of the helical tooth and which orients the helical tooth so that the mounting plate may be lifted off the circle carrying structure without interference between the helical tooth and the spur gear teeth;

and a gear on the drive shaft which directly intermeshes with a gear that is fixed relative to the barrel worm gear.

17. The combination of claim 16 which includes pilot means on the bottom of the support which engages a lower part of the circle carrying structure, whereby driving forces on the support are distributed between said upper and lower parts of said structure.

18. The combination of claim 16 in which the internal spur gear is of hard metal, the barrel worm gear is of a rigid material substantially softer than said hard metal.

19. The combination of claim 16 in which the gear on the drive shaft is a worm gear and the gear which is fixed relative to the barrel worm gear is a spiral gear.

20. In a motor vehicle which includes a mobile frame, a first member on said mobile frame and a second member on said mobile frame which is rotatable relative to said first member about a vertical axis, improved means for driving said second member comprising, in combination:

an internal gear of predetermined pitch diameter on one of said members;

a support detachably mounted on the other of said members inside the circle defined by the internal spur gear;

gear mounting means journalled in said support;

a barrel worm gear non-rotatably mounted for axial sliding movement on the gear mounting means, said worm gear having ends with a convex longitudinal surface therebetween which has a radius of curvature substantially equal to and no greater than that of the internal spur gear, a helical tooth on said convex longitudinal surface which is engaged with the internal spur gear teeth, said helical tooth having a pitch diameter effectively equal to that of the internal spur gear and having a predetermined lead angle, and said worm gear having an axis of rotation which is tilted with reference to the plane of the internal spur gear on an axis which is substantially equal to the lead angle of the helical tooth;

flanges carried by the support which flank the ends of the barrel worm gear to restrict said axial sliding movement of the barrel worm gear;

spring means bearing on the ends of the barrel worm gear and on the flanges to bias said barrel worm gear to a position centered between the flanges;

and means for driving said barrel worm gear.

* * * * *